United States Patent [19]

Crane et al.

[11] Patent Number: 4,824,390

[45] Date of Patent: Apr. 25, 1989

[54] COATED ELECTRICAL CONNECTOR

[75] Inventors: Robert A. Crane, Windham; John J. Napiorkowski, Cape Elizabeth, both of Me.

[73] Assignee: GTE Products Corporation, Stamford, Conn.

[21] Appl. No.: 153,681

[22] Filed: Feb. 8, 1988

[51] Int. Cl.[4] ..... H01R 13/52

[52] U.S. Cl. ..... 439/271; 439/283

[58] Field of Search ..... 439/590, 271–284, 439/936, 933, 893, 892, 247, 248, 380, 381

[56] References Cited

U.S. PATENT DOCUMENTS

| | | | |
|---|---|---|---|
| 3,571,779 | 3/1971 | Collier | 439/271 |
| 4,085,993 | 4/1978 | Cairns | 439/272 |
| 4,109,989 | 8/1978 | Snyder et al. | 439/274 |
| 4,310,210 | 1/1982 | Takahashi et al. | 439/247 |
| 4,425,017 | 1/1984 | Chan | 439/276 |
| 4,527,851 | 7/1985 | Galluser et al. | 439/272 |
| 4,662,692 | 5/1987 | Uken et al. | 439/271 |
| 4,675,779 | 6/1987 | Neuwrith | 439/271 |

*Primary Examiner*—David Pirlot

*Attorney, Agent, or Firm*—James Theodosopoulos

[57] ABSTRACT

An electrical connector, especially for telecommunications, including an electrical insulating block, and an array of cavities disposed in the block. Female contacts are disposed in the cavities and there are corresponding exposed electrical connections attached to the female contacts. An electrically insulating coating of gel-like deformable polymeric silicone material is disposed on the block, in the cavities, and on the female contacts. The coating is deformable and penetratable at ambient temperatures whereby to provide for penetration thereof by mating electrical contacts and enabling an electrical connection between the female and male contacts.

13 Claims, 2 Drawing Sheets

COATED ELECTRICAL CONNECTOR

FIELD OF THE INVENTION

The present invention relates to electrical connectors and particularly to electrical connectors in which the contacts are spaced closely to each other and are susceptible to short circuiting from the effects of moisture that may condense upon it.

SUMMARY OF THE PRIOR ART

Environmental protection of electrical connectors, and especially environmental protection of telephone connectors, has not always been provided for adequately in the prior art. If moisture condenses upon the connectors, or upon the insulating structures that hold them, such moisture can create a current path and allow for the flow of current between individual points on the insulating structures between the connectors.

Prior art methods of preventing such flow of current frequently involved spacing the connectors distantly from each other, that is providing for a current flow path on the insulating support which was long, relative to the spacing between the individual connectors. Commonly, upstanding posts were used with the electrical contacts being disposed on the ends of the posts, since providing distance between electrical contacts can be an easy way to prevent shorting. The upstanding posts provided a long flow path between the electrical contacts, thus providing the insulation.

When moisture condenses upon the electrical contacts, or upon the electrical insulating blocks that hold them, electrical shorts can occur, and such shorts are particularly disadvantageous with telephone lines since they produce static which can reduce the quality of the transmission. If the shorting continues to occur over a long period of time, galvanic action can cause material from one portion of the electrical connection to migrate along the moisture path to another portion of the connector. When this condition occurs often enough, or long enough, permanent electrical short circuits can occur, causing permanent electric problems in the device. In the case of telephone service, where a receptacle may not be observed for a long period of time, and where small amounts of current can cause significant static on the telephone line, the problem of moisture and short circuiting is particularly pronounced. Long spaces between contacts of opposite polarity merely make the equipment bulky and difficult to install, and thus it is desirable to provide a connector that is compact, but still resistant to the effects of moisture condensation.

SUMMARY OF THE INVENTION

According to the present invention, we have found that if the insulating member in which the electrical contact is disposed is coated with a thin coating of a gel-like material, that is a perforateable, deformable polymeric material, deformable at ambient temperatures, whereby to provide for penetration by a mating electrical contact which can be urged against it, then the problems associated with short circuiting due to the creation of a current path with condensed moisture can be eliminated. The gel-like deformable polymeric material is coated on all of the external portions of the insulating member and also upon the electrical contact itself. In the preferred embodiment, the material is deposited in the cavities that hold the female electrical contacts and coats these contacts. The gel-like material can also be deposited on the rear of the connector block, to prevent short circuiting between the electrical contacts on the rear which can also occur due to the condensation of moisture.

Preferably, the gel-like material is a polymeric silicone resin which does not harden at ambient temperatures and can be penetrated, thereby to establish electrical contact between mating male and female members. During insertion, the gel-like material is perforated and moved by the edges of the male contacts that are inserted whereby to provide an electrical connection between the male and female contacts.

DESCRIPTION OF THE PREFERRED EMBODIMENT

Figure 1:
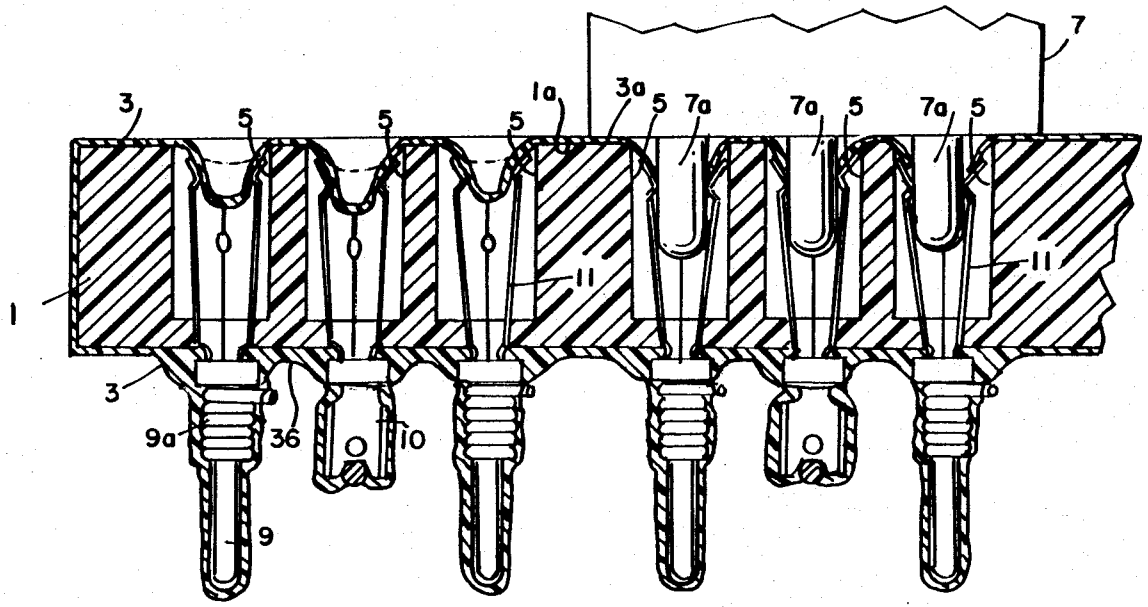
FIG. 1 is a cross-sectional elevational view of a connector block base in which a protector module is disposed in one of the sets of cavities that house the female contacts.
Figure 2:
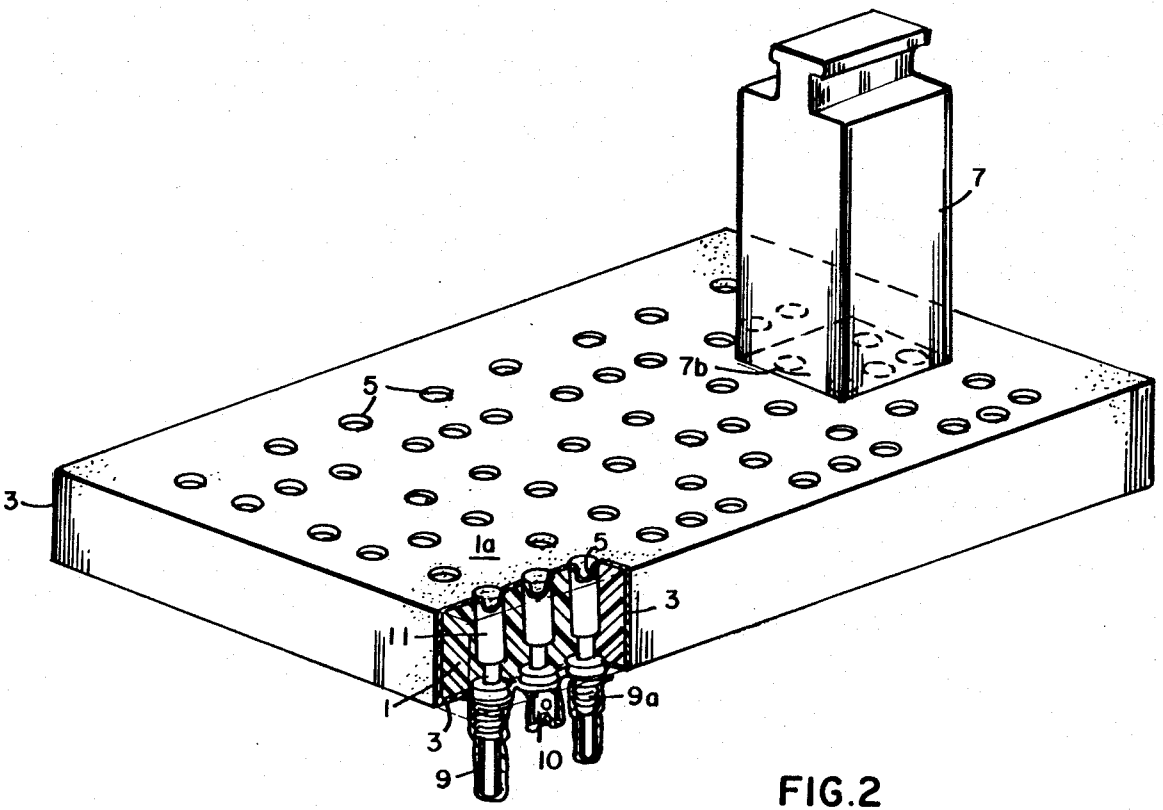
FIG. 2 is a perspective view, partially broken away to reveal the construction of the interior of a similar connector block base.

Referring now to FIGS. 1 and 2, according to the present invention, a connector block base 1 is coated with a gel-like layer 3 which encapsulates substantially all of the insulator block 1. An array of cavities 5, each holding a female connector 11 is disposed in the insulator block 1 in a configuration which will enable the insertion of a five pin protector module 7. Such protector modules having a predetermined configuration of pins 7*a* are well known to the art. When fully inserted, the protector module 7 abuts against the top portion 3*a* of the layer of polymeric gel-like material 3 and can squeeze it between the face 1*a* and the base 7*b*. The squeezing of the gel-like material layer 3 prevents moisture from condensing upon the base 7*b* or the face 1*a* which might allow short circuits between the pins 7*a* on the protector module 7 or the female contacts. Moreover, the film 3 can extend over the base of the protector module 1 and completely encapsulate it, filling the spaces between lead-in wires 9 with wrapped connectors 9*a* and spades 10. The disposition of the gel-like coating 3 in the space between the lead-wires 9 and spades 10 and over these members also prevents moisture from condensing on the base of the protector module 1 and thus electrically insulates the various members from each other. Especially, the gel-like material insulates the wire wrap 9*a*.

It is important to note that the female contacts 11 are fairly loosely disposed in the cavities 5 whereby to compensate for small differences in tolerances in the spacing of the pins 7*a* which form the male contacts. As is well known, the spacing of the pins 7*a* may vary slightly from module to module, and the female contacts 11 can yield in their relative spacing so as to compensate for these differences. Because of the elasticity of the coating 3, it will also yield somewhat to the movement female contacts 11 produced by the insertion of the male contacts and the beneficial effects of the prevention of the condensation will not be reduced.

In preparing the environmental sealing according to the present invention, we have found that it is best to dip the entire connector block base into the nonconductive gelatinous material whereby to coat all of the surfaces. The dipping is usually provided after all the wire wrapping is completed on the rear surface of the connector. In this way, we have found that there are no electrical surfaces exposed for moisture to condense upon.

When the protector module is inserted into a connector treated in this manner, the gel material can be penetrated when the mating contact is inserted into the cavities of the connector block, and it will be wiped away to insure a solid electrical connection. Moreover, it should be pointed out that the gel-like polymeric materials have memories in that when a protector module is removed from the original connector base, the gel material will partially and gradually return to its original position and thus afford a limited protection to the connector after usage.

In the preferred embodiment, we have found that coating thickness between about 0.005 and 0.020 inch are most desirable. Below about 5 mils, there is inadequate thickness to provide the electrical insulation that is necessary to prevent the short circuiting that we desire. Above about 20 mils, the thickness is such that it cannot be readily squeezed away and penetrated by the insertion of a mating contact, and the devices cannot always be properly attached nor can electrical connections always be made reliably.

We have found it desirable to use gel-like penetratable polymeric materials formed from two component systems which have as a first component, a material such as polymeric silicone gels that are a mixture of less than about 5% amorphous silica and above about 90% silicon, blending with conventional curing agents, and as the second component between about 80 and 90% polymeric silicone blended with less than about 10% polysiloxandiol, less than about 5% amorphous silica and less than about 10% conventional hardeners. When the first and second components are mixed together, they will form a clear, water white, silicone potting and encapsulating compound. The silicone encapsulating compound cures to yield a very soft silicone gel for use as an encapsulant or protective insulator according to the present invention.

The gel maintains constant properties in air over a very broad temperature range from between about −50° C. to about 180° C. for very long periods of time, even at elevated temperatures. Typical of the types of silicone dielectric gels that can be used are the ones sold by Amicon Corporation and especially one called Amicon LS2334-31. This two-component system adequately pots the electrical parts and can prevent the arcing and short circuiting described above.

It is apparent that modifications and changes can be made within the spirit and scope of the present invention, but it is our intention, however, only to limited by the scope of the appended claims.

As our invention, we claim:

1. An electrical connector comprising:

an electrical insulating member, and at least two exposed electrical contacts disposed in said member;

an electrically insulating coating of self-adhering gel-like deformable polymeric material disposed on said member and said contacts, said material being deformable and penetratable at ambient temperatures whereby to provide for penetration thereof by mating electrical contacts and enabling an electrical connection between said male and female contacts.

2. The electrical connector according to claim 1 wherein the perforatable electrically insulating coating is disposed over the front and rear of said insulating member.

3. The electrical connector according to claim 1 wherein the gel-like material coating said insulating member is a silicone gel, said silicone gel being gel-like at ambient temperatures.

4. The electrical connector according to claim 1 including an array of cavities disposed on the front of said electrical insulating member, and electrical contacts disposed in said cavities.

5. The electrical connector according to claim 4 wherein the perimeter of the cavities define the receptacles for female contacts.

6. The electrical connector according to claim 1 wherein the female contacts are expandable tubular members, said tubular members having electrical connections disposed at one end thereof and openings disposed at the other end thereof, said openings being adapted to receive said mating electrical contacts.

7. The electrical connector according to claim 6 wherein the female contacts are free to move within said cavities on a plane normal to the axis of the tubular member, whereby to receive male contacts of non-uniform spacing.

8. An electrical connector comprising:

an electrical insulating block, and an array of cavities disposed in the front of said block, an array of female contacts adapted to receive male contacts disposed in said cavities and a corresponding array of exposed electrical connections attached to said female contacts and extending from the rear of said insulating block;

a self-adhering electrically insulating coating of a gel-like deformable polymeric material disposed on said block, in said cavities, and on said contacts, said coating being deformable and penetratable at ambient temperatures whereby to provide for penetration by mating electrical contacts and enabling an electrical connection between said male and female contacts.

9. The electrical connector according to claim 8 wherein the perforatable electrically insulating coating is disposed over the front and rear of said insulating block.

10. The electrical connector according to claim 8 wherein the gel-like material coating said insulating member is a silicone gel, said silicone gel being gel-like at ambient temperatures.

11. The electrical connector according to claim 8 wherein the perimeter of the cavities define the receptacles for the female contacts.

12. The electrical connector according to claim 11 wherein the female contacts are expandable tubular members, said tubular members having electrical connections disposed at one end thereof and openings disposed at the other end thereof, said openings being adapted to receive said mating male contacts.

13. The electrical connector according to claim 12 wherein the female contacts are free to move within said cavities on a plane normal to the axis of the tubular member, whereby to receive a connector with male contacts extending therefrom of non-uniform spacing.

* * * * *